United States Patent [19]

Hartnig

[11] 4,131,272

[45] Dec. 26, 1978

[54] METHOD AND APPARATUS FOR SEPARATING A CONTINUOUS STREAM OF CONNECTED BUSINESS FORMS INTO EXACT COUNT ZIG-ZAG FOLDED STACKS

[75] Inventor: Richard E. Hartnig, Green Bay, Wis.

[73] Assignee: Paper Converting Machine Company, Green Bay, Wis.

[21] Appl. No.: 806,110

[22] Filed: Jun. 13, 1977

[51] Int. Cl.[2] ..... B65H 45/16

[52] U.S. Cl. ..... 270/73; 225/100; 270/79

[58] Field of Search ..... 270/61 F, 73, 79; 53/66, 116, 11 T; 225/100–101, 32; 93/93 DP

[56] References Cited

U.S. PATENT DOCUMENTS

| | | | |
|---|---|---|---|
| 2,250,572 | 7/1941 | Cumfer | 270/79 |
| 2,899,871 | 8/1959 | Auer | 225/100 |
| 3,214,162 | 10/1965 | Breidenbach | 270/73 |
| 3,496,698 | 2/1970 | Wichmann | 53/117 |
| 3,560,309 | 2/1971 | Gruver | 225/100 |

*Primary Examiner*—Edgar S. Burr
*Assistant Examiner*—A. Heinz
*Attorney, Agent, or Firm*—Tilton, Fallon, Lungmus & Chestnut

[57] ABSTRACT

A method and apparatus for separating a continuous stream of connected business forms into exact count zig-zag folded stacks wherein nip forming rolls are selectively engaged to burst the web stream at a predetermined point and prior to zig-zag folding.

8 Claims, 2 Drawing Figures

METHOD AND APPARATUS FOR SEPARATING A CONTINUOUS STREAM OF CONNECTED BUSINESS FORMS INTO EXACT COUNT ZIG-ZAG FOLDED STACKS

BACKGROUND AND SUMMARY OF INVENTION

This invention relates to a method for separating a continuous stream of connected business forms or like web products into exact count zig-zag folded stacks so as to provide the same for packaging. With the ever increasing use of computers, sizable volumes of business forms are used daily. These forms are normally provided in accordion or zig-zag folding along transverse lines of perforation. Also, it is the normal practice to equip the continuous web or webs making up the business forms with control margins having line holes for engagement with pin belts on the computer printout.

In the manufacture of such zig-zag folded forms, the webs are processed at high speed (of the order of 1500 feet per minute) from parent rolls. The web material wound into the parent rolls may have been printed previously or may be printed on the business form machine. In addition, the business form machine will provide the line holes making up the control margins and cross perforate the web or webs to define the individual business forms. At the end of the business form machine, a zig-zag folder is provided which delivers a stream of accordion pleated forms. In the past, a machine operator has had to be positioned at the output side of the ziz-zag folder to burst the web material every so often so as to separate the zig-zag folded forms into stacks handleable for cartoning. For example, a normal carton will accommodate about 3,000 business forms. With the business forms having popular lengths of 8½ or 11", it will be apparent that at the speeds contemplated, this separation occurs every few minutes. To give the operator some idea of where the separation is to occur, the practice has been to apply a stripe of ink along one of the control margins during the process of manufacture. Because the web material is traveling at such high speed, it is virtually impossible to limit this stripe to a specified or given or line of cross perforation. In fact, the stripe, even if applied carefully, normally extends over several business forms and it has been the practice for the operator to select the line of cross perforation approximately midway of the length of this stripe. The operator then utilizes a dull knife or similar shearing instrument to slash through the zig-zag forms and separate the same into stacks. It will be immediately apparent that this established procedure does not result in "exact count" stacks. Further, it is time-consuming and expensive in requiring the continuous attention of the operator.

According to the invention, these problems are avoided and by performing the bursting at a time and place not heretofore known, i.e., before the web goes into the zig-zag folding station. The web is literally "burst" along a line of cross perforation which is preselected to yield an exact count, viz., 3,000 business forms, for example. In the illustrated embodiment, this is achieved by simultaneously nipping the web between two sets of rolls, the first set running at web speed while the second, or downstream set, runs faster than the web speed. Thus, the downstream set of rolls applies a tension stress to the web to burst the same along a line of cross perforation that is located between the two sets of rolls.

The basic idea of "bursting" utilizing two sets of rolls is not new in itself. This is conventionally employed on the downstream side of the computer where the web material is burst at every cross perforation — as in the case of providing insert mailers. However, it is believed unknown to selectively burst a business form web at a few widely spaced pre-selected points in conjunction with the preparation of the same for zig-zag folding.

According to the invention, optimum results are achieved by using arcuate pads for the bursting rolls so as to avoid any possibility of marking, ironing or wrinkling the web material. The arcuate pad idea for selective bursting is in itself known as can be seen in co-owned patent No. 3,498,558. However, again there has been no appreciation of the merit of utilizing this construction and operation in a machine and method for developing exact count zig-zag folded business forms.

DETAILED DESCRIPTION:

The invention is described in conjunction with an illustrative embodiment in the accompanying drawing, in which —

Figure 1:
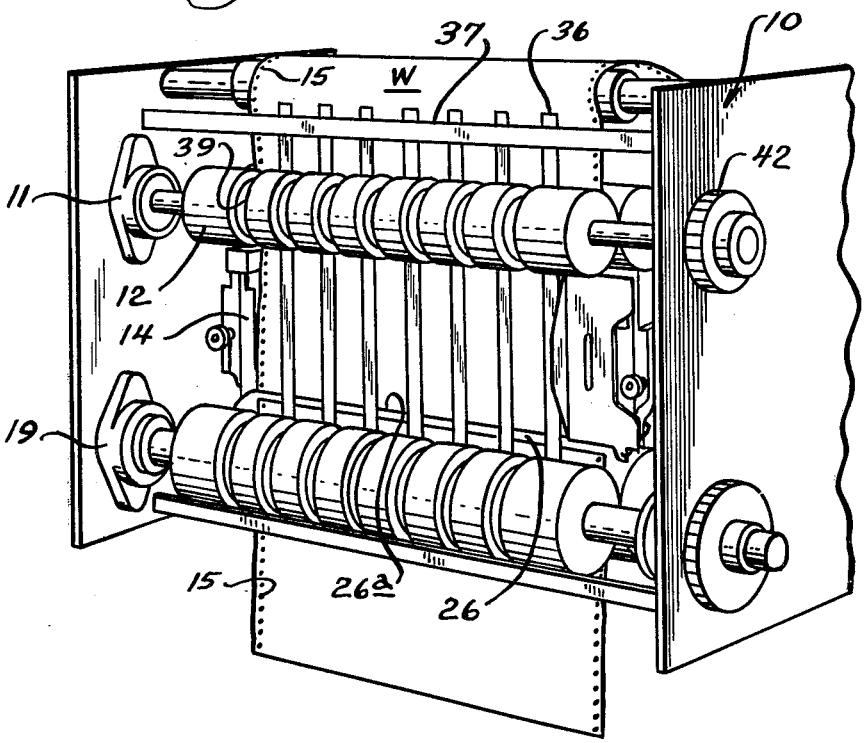
FIG. 1 is a fragmentary perspective view of the inventive apparatus.

In the illustration given, the numeral 10 designates generally the frame of the inventive machine which is seen to provide a bearing support as at 11 for a rotating element 12.

In the illustration given, the web W is seen to be directed along a linear path — vertically downward, as illustrated. The web W is seen to be partially wrapped an idler roll 13 which directs the web downwardly into the linear path generally designated by the symbol P in FIG. 2.

In the illustration given, the web W is continuously advanced in the path P by means of a pin belt mechanism generally designated 14. Advantageously, a pair of such mechanisms are provided, one for each of the control margins. As can be appreciated from a consideration of FIG. 1, the web W is equipped with line holes 15 along each marginal edge.

Figure 2:
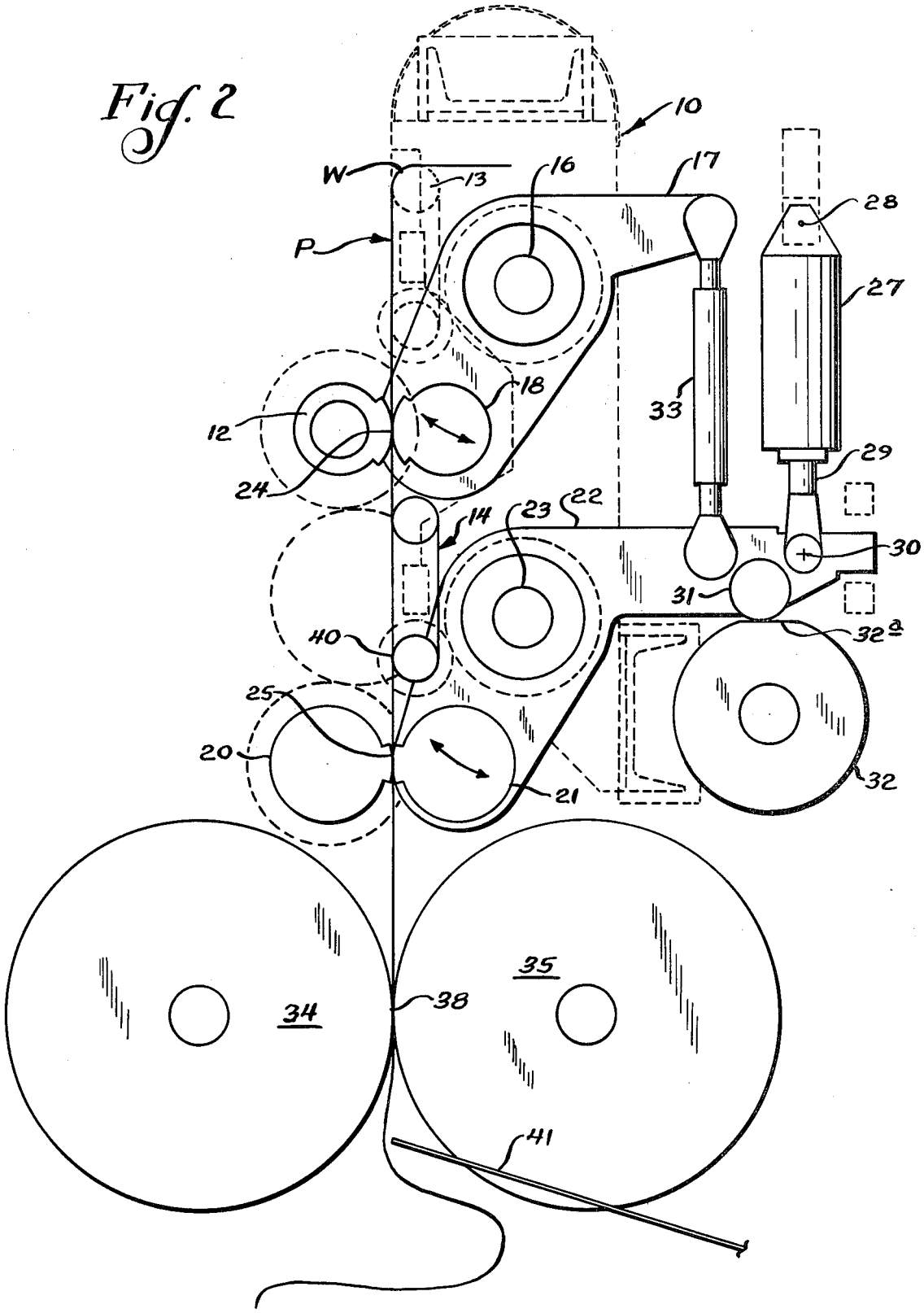
FIG. 2 is a fragmentary side elevational view of the inventive apparatus.

Referring now to FIG. 2, it will be seen in the upper central portion thereof that the frame 10 supports a pivot shaft 16. Rotatably mounted on the pivot shaft 16 is an L-shaped pivot arm 17. The pivot arm 17 in its lower left hand portion rotatably supports a rotatable element 18 which coacts with the rotatable element 12 in providing a pair of roll-like elements for applying a nipping force. The term "nipping force" refers to the fact that the elements 12 and 18 can grip a web passing therebetween in a manner analogous to the clamping or gripping achieved of webs in the nips of conventional rolls. In the illustration given, the rotatable elements 12 and 18 have arcuate segments of greater radii of curvature than the remainder of the rolls. This is exaggerated in FIG. 2, it only being necessary to have a pad of material applied to a conventional roll wherein the thickness of the pad of material is but a fraction of an inch. This provides, in effect, a discontinuous roll — a continuous roll would tend to iron the web and introduce wrinkles — and if carbons or carbon backing is provided on the business form web material, tend to mark the same.

Referring again to FIG. 1, the numeral 19 represents a bearing pedestal which rotatably supports the element 20. Cooperating with the element 20 is a second rotatable element 21 which, like the element 18 is mounted on an L-shaped pivot arm — in this case the lower pivot arm being designated by the numeral 22. The pivot arm 22 is pivotally mounted on a pivot shaft 23 supported in the frame 10.

In the illustration given, the diameters of the rolls 20 and 21 are greater than the diameters of the rolls 12 and 18 so that when the rolls 12, 18, 20 and 21 all rotate at the same speed, there will be a faster surface speed provided in the nip between rolls 20 and 21 than there is between the rolls 12 and 18. This results in a tension being applied to the web clamped, in effect, between the point 24 (between the rolls 12 and 18) and the point 25 (between the rolls 20 and 21). This results in a bursting or severance along a line of previously introduced cross perforation and such is illustrated as at 26 in FIG. 1.

To apply the spaced apart nipping forces at a selected time, i.e., after a predetermined number of lines of cross perforation have passed a point in the path P, means in the form of an air cylinder 27 (see FIG. 2) are provided for pivoting the arms 17 and 22. As illustrated, the air cylinder 27 is pivotally supported on the frame 10 as at 28 and has an extendable piston rod 29 pivotally connected to the L-shaped pivot arm 22 at the point 30. Thus, as the time for bursting approaches, the air cylinder is energized to extend the piston rod 29 and pivot the arm 22 in a clockwise fashion about the pivot shaft 23. However, since the time required for the nipping force application is relatively short and the reaction time of an air cylinder is relatively long, a fine control over the force application is provided in the form of a cam follower 31 rotatably mounted on the pivot arm 22 which cooperates with a rotating cam 32 also mounted on the frame 10. Thus, after the air cylinder has been energized to extend the piston rod 29, the pivot arm 22 is pivoted counterclockwise to position the rotating element 21 is very close to clamping or nipping relationship with the rotating element 20. Thereafter, when the cam 32 rotates so as to position the active contour 32*a* in contact with the cam follower 31, the clamping or nipping operation is completed by virtue of closing the relatively small remaining gap between the elements 20 and 21.

In the illustration given, it is preferred to similarly actuate the rotating element 18 although it may be possible in some instances to utilize continuously rotating, nip providing rolls for these elements if the possibility of wrinkling or ironing can be tolerated. Preferably, however, the pivot arm 17 is connected by means of a pivot linkage 33 to the pivot arm 22 so that as the cam follower 31 contacts the flat 32*a*, the rotating element 18 moves into nip force application relative to the element 12 just as the element 21 moves into similar engagement with the element 20.

The points 24 and 25 (representing the contact areas of the upper roll pair 12 and 18 and the lower roll pair 20 and 21, respectively) are spaced apart a distance less than the length of a business form being processed, i.e., the distance between adjacent lines of cross perforation 26. As indicated previously, this is normally 8½ or 11" for the more popular sizes of business forms. Thus, only a single line of cross perforation 26 will be positioned between the points 24 and 25 at any given time. To insure that the leading edge 26*a* of the first web (see FIG. 1) continues to travel in the path P to the folding rolls 34 and 35, guide bars 36 extending on each side of the path P are provided. More particularly, the guide bars are supported by cross members as at 37 (see FIG. 1). The guide bars 36 extend to a point shortly above the nip 38 between the folding rolls 34 and 35. The folding rolls 34 and 35 are equipped with the normal tuckers and grippers (not shown) but which are widely used in this art. To accommodate the guide bars 36, the rotating elements 12, 18, 20 and 21 are grooved as at 39 (see FIG. 1).

In addition to serving to advance the web W in the path P, the pin belt mechanism 14 also serves to give an even greater control over the first web W. The time of application of the nipping force is arranged (by virtue of the contour and operation of the cam 32) to occur when the line of cross perforation to be burst is between the downstream end of the pin belt mechanism 14 and the nip point 25, i.e., between the points 25 and 40 as illustrated in FIG. 2. Further, the apparatus is arranged so that the distance between the last contact point 40 of the pin belt mechanism 14 and the nip 38 between the folding rolls 34 and 35 is also less than the length of the business form. This insures that the line of perforation immediately preceding the line along which bursting is occurring is gripped by the rolls 34 and 35.

Thereafter, the web issues from the folding rolls 34 and 35 in the zig-zag form illustrated in FIG. 2 and the last portion or tail of a given stack can be pressed downwardly onto the stack by means of a diving finger 41 which normally is supported in retracted position within an annular slot in the folding roll 35. The finger 41 serves to pack the last loose panel or business form and also serves as a separator to temporarily support the beginning of a new stack of zig-zag folded forms while the just completed stack is moved out of the path P (as by a pusher) and into a cartoning operation. Thus, the need for an operator to attend the output of the folding rolls 34 and 35 is avoided.

Should space or other operational considerations preclude the positioning of the folding rolls 34 and 35 as described above, earlier control (relative to the path P) of the leading edge 26*a* of the burst web can be achieved through the use of vacuum ports in the folding rolls.

Omitted for the clarity of presentation are all of the gears associated with the rotating elements 12, 18, 20 and 21. The gear associated with the element 12 — as at 42 and the gear 43 associated with the element 20 are illustrated in FIG. 1. Because of space considerations, the gearing associated with the elements 18 and 21 must be offset axially relative to the gears 42 and 43. However, the stationary nature of the pivot shafts 16 and 23 make this readily possible.

Through the use of the arcuate pads on the elements 12, 18, 20 and 21, it is possible to have a substantial amount of time in which to actuate or deactuate these elements. For example, the arcuate length of the pads is of the order of 60°. Thus, 300° of rotation is available for moving the element 21, for example, out of nipping force application (as by the cam 32) before the pads again come into coacting relation.

While in the foregoing specification a detailed description of an embodiment of the invention has been set down for the purpose of setting forth the best mode presently known of practicing the invention, many variations in the details hereingiven may be made by those skilled in the art without departing from the spirit and scope of the invention.

I claim:

1. In a method of separating a continuous stream of connected business forms into exact count zig-zag folded stacks for packaging, the steps of:

continuously advancing an elongated web along a linear path toward a station for zig-zag folding, said web including a longitudinally extending control margin and equally spaced apart lines of perforation defining business forms therebetween, after a predetermined number of said lines of perforation have passed a point in said path, applying nipping forces to said web along transverse lines upstream and downstream of a given line of perforation and within the length of the business forms on either side of said given line of perforation, the downstream nipping force imparting a higher velocity to said web than the upstream nipping force whereby said web is burst along said given line of perforation, removing at least said downstream nipping force from said web prior to the time the line of perforation subsequent to said given line of perforation passes the line of application of said upstream nipping force, and zig-zag folding said web in said station along each said line of perforation, the line of perforation immediately preceding said given line of perforation being gripped incident to zig-zag folding at about the time of web bursting along said given line of perforation.

2. The method of claim 1 in which the position of said given line of perforation at the time of bursting is controlled by engaging said control margin upstream of said given line of perforation and downstream of said line of application of said upstream nipping force.

3. The method of claim 1 in which the web portion upstream of said given line of perforation is guided past the line of application of said downstream nipping force and into said station.

4. In apparatus for separating a continuous stream of connected forms into exact count zig-zag folded stacks for packaging, a frame, means operably associated with said frame for continuously advancing an elongated web along a linear path toward a station for zig-zag folding, said web including a longitudinally extending control margin and equally spaced apart lines of perforation defining business forms therebetween, means on said frame for applying nipping forces to said web along transverse lines upstream and downstream of a given line of perforation and within the length of the business forms on either side of said given line of perforation, the means for applying the downstream nipping force imparting a higher velocity to said web than the means for applying the upstream nipping force whereby said web is burst along said given line of perforation, means on said frame controlling the application of said forces to a time after a predetermined number of said lines of perforation have passed a given point in said path and for removing at least said downstream nipping force from said web prior to the time the line of perforation subsequent to said given line of perforation passes the point of application of said up-stream nipping force, and a pair of rolls on said frame downstream of said nip force applying means for zig-zag folding said web along each line of perforation.

5. The apparatus of claim 4 in which pin belt means for conveying at least a portion of said web is provided between said transverse lines, said pin belt means having a downstream end and said pair of rolls for zig-zag folding having a nip, said downstream end of said pin belt means and said zig-zag folding rolls nip being spaced apart less than the distance between said equally spaced lines of perforation.

6. In apparatus for separating a continuous stream of connected business forms into exact count zig-zag folded stacks for packaging, a frame, means operably associated with said frame for continuously advancing an elongated web along a linear path toward a station for zig-zag folding, said web including a longitudinally extending control margin and equally spaced apart lines of perforation defining business forms therebetween, means on said frame for applying nipping forces to said web along transverse lines upstream and downstream of a given line of perforation and within the length of the business forms on either side of said given line of perforation, the means for applying the downstream nipping force imparting a higher velocity to said web than the means for applying the upstream nipping force whereby said web is burst along said given line of perforation, and means on said frame controlling the application of said forces to a time after a predetermined number of said lines of perforation have passed a given point in said path and for removing at least said downstream nipping force from said web prior to the time the line of perforation subsequent to said given line of perforation passes the line of application of said up-stream nipping force, said means for applying said nipping forces including two pairs of rotating elements, the elements in each pair flanking said path, and a pin belt on said frame between said pairs of rotating elements for engaging the control margin which is upstream of said given line of perforation and downstream of said line of application of said upstream nipping force.

7. The apparatus of claim 6 in which said elements are equipped with axially spaced apart grooves, and guide bar means mounted on said frame extending through said grooves for directing the free edge of a burst web toward said station.

8. The apparatus of claim 6 in which a pivot arm is mounted on said frame, one of the elements for applying the downstream nipping force being mounted on said arm, and means on said frame for pivoting said arm after a predetermined number of lines of perforation have passed a given point in said path.

* * * * *